US011606855B1

(12) United States Patent
Hong et al.

(10) Patent No.: US 11,606,855 B1
(45) Date of Patent: Mar. 14, 2023

(54) STATIC ELIMINATOR HAVING OFFSET VOLTAGE REDUCTION UNIT

(71) Applicant: DONG IL TECHNOLOGY LTD., Hwaseong-si (KR)

(72) Inventors: Dae Ju Hong, Hwaseong-si (KR); Joo Hun Yun, Hwaseong-si (KR); No Baek Kwak, Hwaseong-si (KR); Min Je Kim, Hwaseong-si (KR)

(73) Assignee: Dong IL Technology Ltd., Hwaseong-si (KR)

( * ) Notice: Subject to any disclaimer, the term of this patent is extended or adjusted under 35 U.S.C. 154(b) by 0 days.

(21) Appl. No.: 17/485,578

(22) Filed: Sep. 27, 2021

(51) Int. Cl.

| | |
|---|---|
| ***H05F 3/00*** | (2006.01) |
| ***H01T 19/00*** | (2006.01) |
| ***H01T 23/00*** | (2006.01) |
| *H05F 3/06* | (2006.01) |
| *H01J 27/02* | (2006.01) |

(52) U.S. Cl.
CPC ..... *H05F 3/00* (2013.01); *H01T 19/00* (2013.01); *H01T 23/00* (2013.01); *H01J 27/02* (2013.01); *H05F 3/06* (2013.01)

(58) Field of Classification Search
CPC ... H05F 3/00; H05F 3/06; H01T 23/00; H01T 19/00; H01J 27/02; H01J 37/12
USPC ..... 361/231
See application file for complete search history.

(56) References Cited

U.S. PATENT DOCUMENTS 6,653,638 B2 * 11/2003 Fujii ..... H01T 23/00 250/326
2002/0093779 A1 * 7/2002 Fujii ..... H01T 23/00 361/231

* cited by examiner

*Primary Examiner* — Danny Nguyen
(74) *Attorney, Agent, or Firm* — Han's Law Office

(57) ABSTRACT

Disclosed is a static eliminator having an offset voltage reducing structure capable of improving antistatic performance for a charged body by reducing an ion offset voltage. The present static eliminator comprises a static eliminator body having an air passage through which high-pressure air is supplied, a plurality of discharge structures installed at the lower end of the static eliminator body to supply the high-pressure air passing through the air passage, and generating positive/negative ions by discharging using the applied high voltage, and an offset voltage reduction unit having a plurality of openings formed to allow the positive/negative ions and high-pressure air to pass therethrough, and installed to cover at least some of the plurality of discharge structures.

6 Claims, 11 Drawing Sheets

STATIC ELIMINATOR HAVING OFFSET VOLTAGE REDUCTION UNIT

BACKGROUND

Field

The present invention relates to a static eliminator for removing static electricity from a charged body by using ion generation, and more particularly, to a static eliminator having an offset voltage reducing structure capable of improving antistatic performance for a charged body by reducing an ion offset voltage.

Description of the Related Art

A static eliminator is a device that removes static electricity by using corona discharge. In general, a static eliminator applies a high voltage to a discharge structure including a discharge pin to generate a corona discharge between neighboring opposite electrodes, thereby inducing generation of ions. When the applied high voltage is a positive (+) voltage, positive (+) ions are generated, and when the applied high voltage is a negative (−) voltage, negative (−) ions are generated.

The thus generated ions are carried in high-pressure air supplied to air holes of the discharge structure through a separate blowing means and are discharged in the direction of the charged body to neutralize the charged body. For example, when a charged body is charged with a positive (+) charge, the positive ions can be repelled and neutralized by combining with the negative ions.

Generally, there are two methods for generating positive and negative ions. The first method is to apply a positive (+) voltage to one of two neighboring discharge pins and a negative (−) voltage to the other discharge pin. The second method is to sequentially generate ions by applying a positive (+) voltage and a negative (−) voltage to one discharge pin as pulses.

As described above, the concentration of the ions generated by the static eliminator decreases as the ions are carried by high-pressure air and spread. Accordingly, the farther the charged body is located, the worse the antistatic performance may be.

Meanwhile, when the distance between the static eliminator and the charged body becomes an ultra-short distance of, for example, about 10 mm, a phenomenon in which the antistatic performance with respect to the charged body is rather deteriorated occurs. A clear theoretical basis for this has not been presented so far. Accordingly, even when the distance between the static eliminator and the charged body is extremely narrow, there is a need for a technology capable of improving the antistatic performance of the charged body.

SUMMARY

The present invention was devised in consideration of the above problems, and an objective of the present invention is to provide a static eliminator comprising an offset voltage reduction unit capable of improving antistatic (static elimination) performance to an offset voltage of ±35V or less (maximum and minimum voltage width is 70 Vp-p or less), as requested by ANSI ESD S20.20-2014, without slowing down the decay time even when the distance to the charged body is very short, by not being affected by ions generated during static discharge.

In order to achieve the above objective, a static eliminator according to the present invention comprises: a static eliminator body having an air passage through which high-pressure air is supplied; a plurality of discharge structures installed at the lower end of the static eliminator body to supply the high-pressure air passing through the air passage, and generating positive/negative ions by discharging using the applied high voltage; and an offset voltage reduction unit having a plurality of openings formed to allow the positive/negative ions and high-pressure air to pass therethrough, and installed to cover at least some of the plurality of discharge structures.

Here, the offset voltage reduction unit may be formed to have a side portion that opens at least one side of the static eliminator body or covers at least some portions of both sides of the static eliminator body, and a lower end portion that covers the at least some of the plurality of discharge structures. In addition, the offset voltage reduction unit may be hinge-coupled with respect to the static eliminator body to be cleaned in a state in which the inside thereof is open.

In addition, the offset voltage reduction unit may be hinge-coupled with respect to the static eliminator body to be cleaned in a state in which the inside thereof is open, and may be composed of any one of a mesh made of metal, a metal plate having a plurality of through-holes formed therein, or a grill in which metal wires are arranged in one direction.

In addition, the offset voltage reduction unit may be assembled with any one of a mesh made of metal, a metal plate having a plurality of through-holes formed therein, or a grill in which metal wires are arranged in one direction with an extruded metal rail to then be integrally formed therewith.

In addition, the offset voltage reduction unit may include at least two sub-electrodes that are bent to have a side portion that covers at least portions of both sides of the static eliminator body and a lower end portion that covers at least some of the plurality of discharge structures.

In addition, the offset voltage reduction unit may be attached to the static eliminator body by means of a fastening member.

To achieve the above objective, provided is a static eliminator comprising: a static eliminator body having an air passage through which high-pressure air is supplied; a plurality of discharge structures installed at the lower end of the static eliminator body to supply the high-pressure air passing through the air passage, and generating positive/negative ions by discharging using the applied high voltage; and an offset voltage reduction unit having a plurality of openings formed to allow the positive/negative ions and high-pressure air to pass therethrough, and installed to cover at least some of the plurality of discharge structures, wherein the offset voltage reduction unit includes: a side portion that covers at least portions of one side of the static eliminator body; and a lower end portion that is bent with respect to the side portion and covers at least portions of the discharge structures, and the side portion is coupled to the static eliminator body so as to be rotatable within a predetermined range.

As described above, by reducing the offset voltage between the static eliminator and the charged body according to the present invention, the static eliminator can prevent deterioration of the antistatic performance even when the distance between the static eliminator and the charged body is an ultra-short distance.

In addition, the static eliminator according to the present invention is configured to be very easily attached and detached when necessary, and thus cleaning and maintenance of the discharge structure can be conveniently performed.

DETAILED DESCRIPTION

Hereinafter, a static eliminator having an offset voltage reduction structure according to an embodiment of the present invention will be described in detail with reference to the accompanying drawings.

Figure 1:
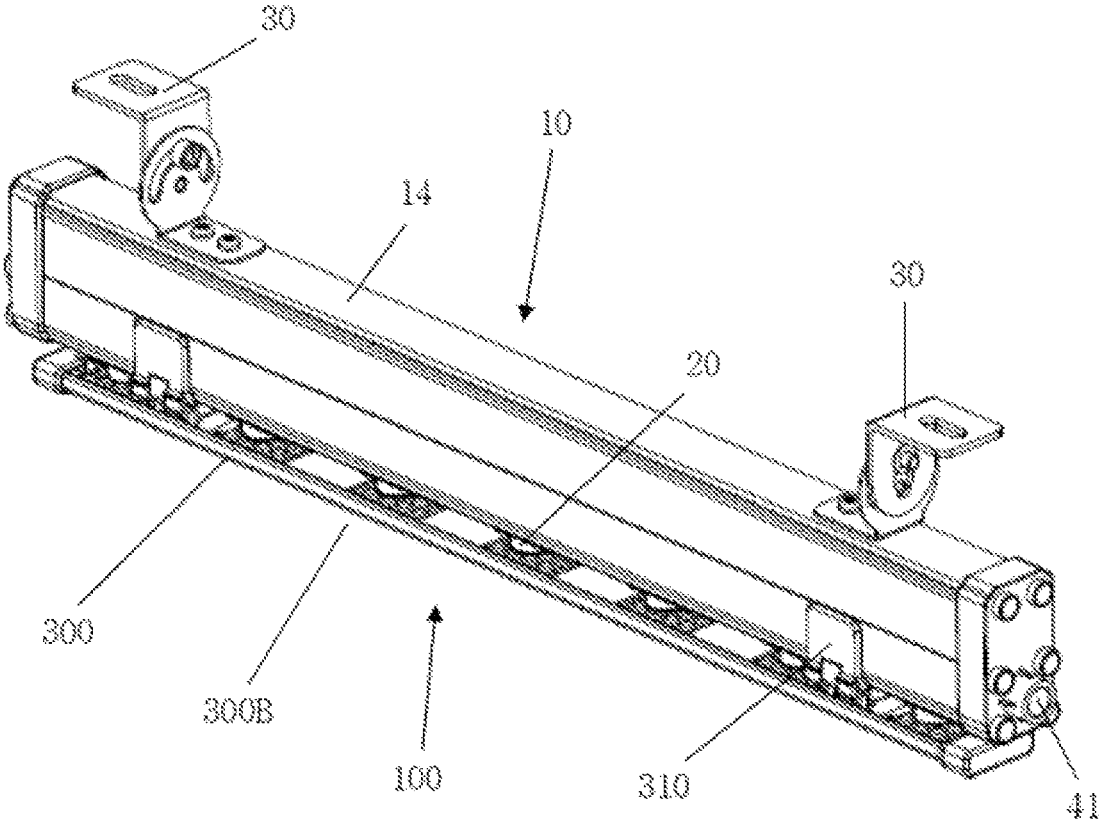
FIG. 1 is a perspective view showing a static eliminator having an offset voltage reduction unit according to an embodiment of the present invention.
Figure 2:
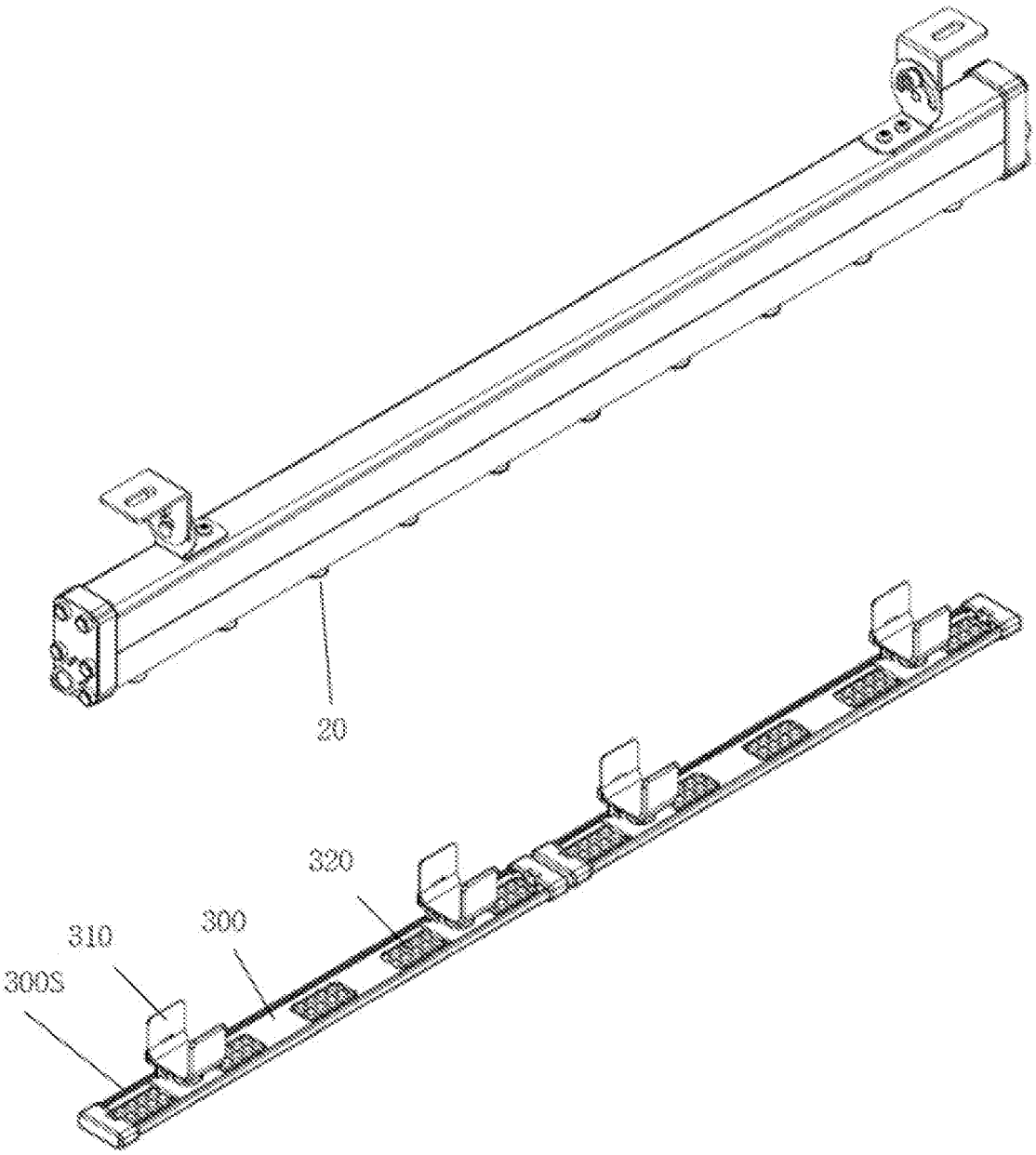
FIG. 2 is an exploded perspective view of FIG. 1.
Figure 3:
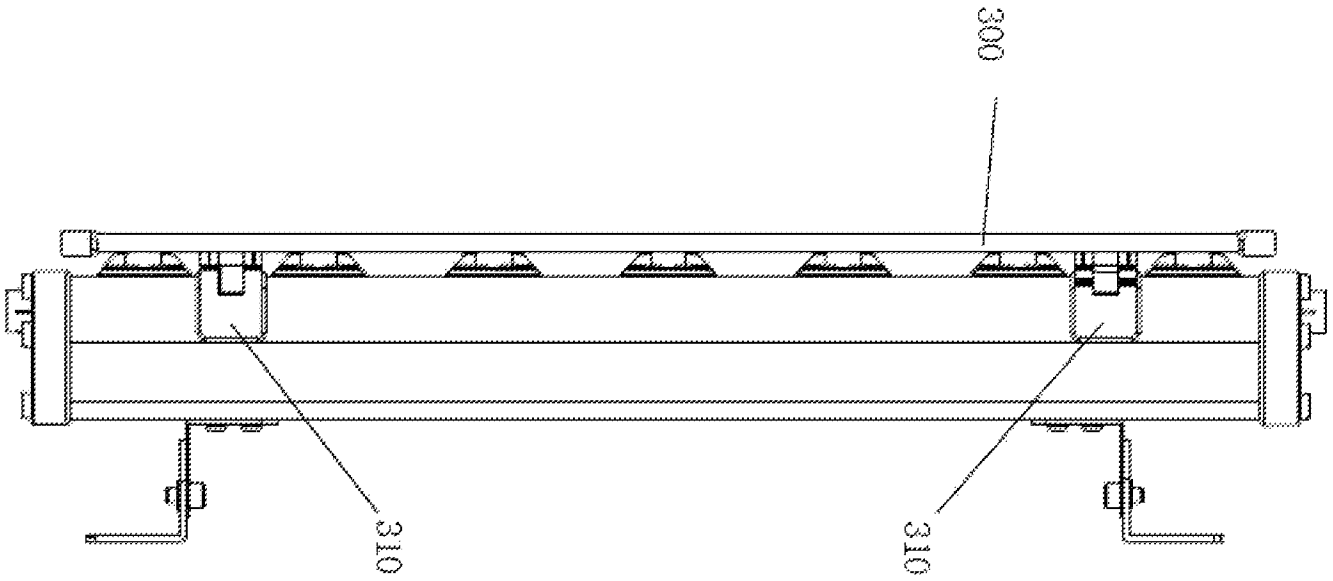
FIGS. 3 to 5 are a front view, a top view, and a side view of FIG. 1, respectively.
Figure 4:
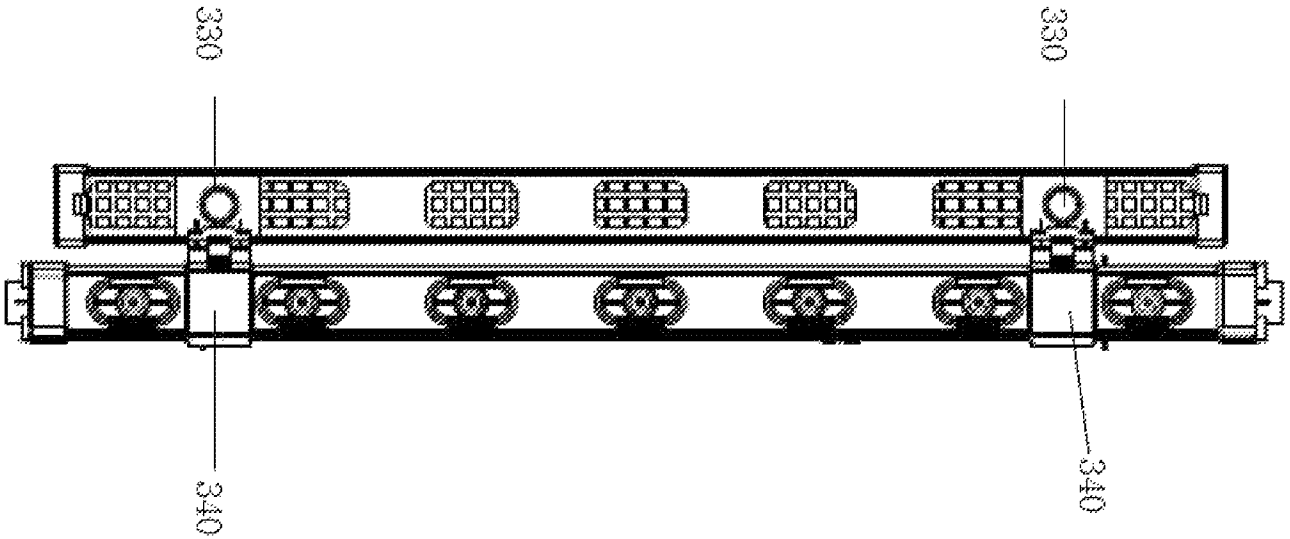
Figure 5:
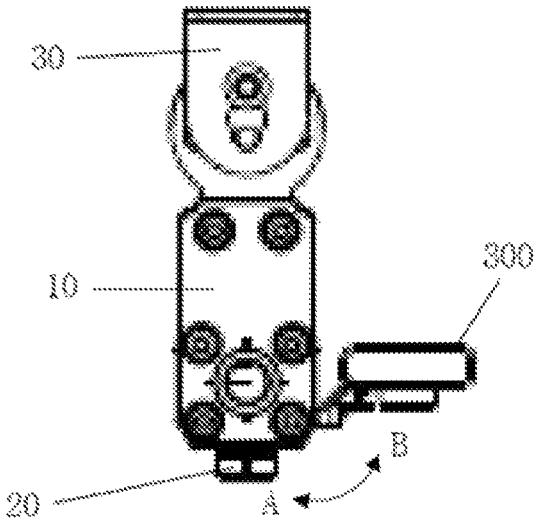

FIG. 1 is a perspective view showing a static eliminator having an offset voltage reduction unit according to an embodiment of the present invention, FIG. 2 is an exploded perspective view of FIG. 1, and FIGS. 3 to 5 are a front view, a top view, and a side view of FIG. 1, respectively.

Referring to the drawings, the static eliminator 100 according to an embodiment of the present invention includes a plurality of discharge structures 20 and an offset voltage reduction unit 300. The discharge structure 20 is installed at the lower end of the static eliminator body 10 so as to supply high-pressure air passing through the air passage, and generates positive/negative ions by discharging by using the applied high voltage. The offset voltage reduction unit 300 is provided in the static eliminator body 10 that generates ions by corona discharge.

Figure 6:
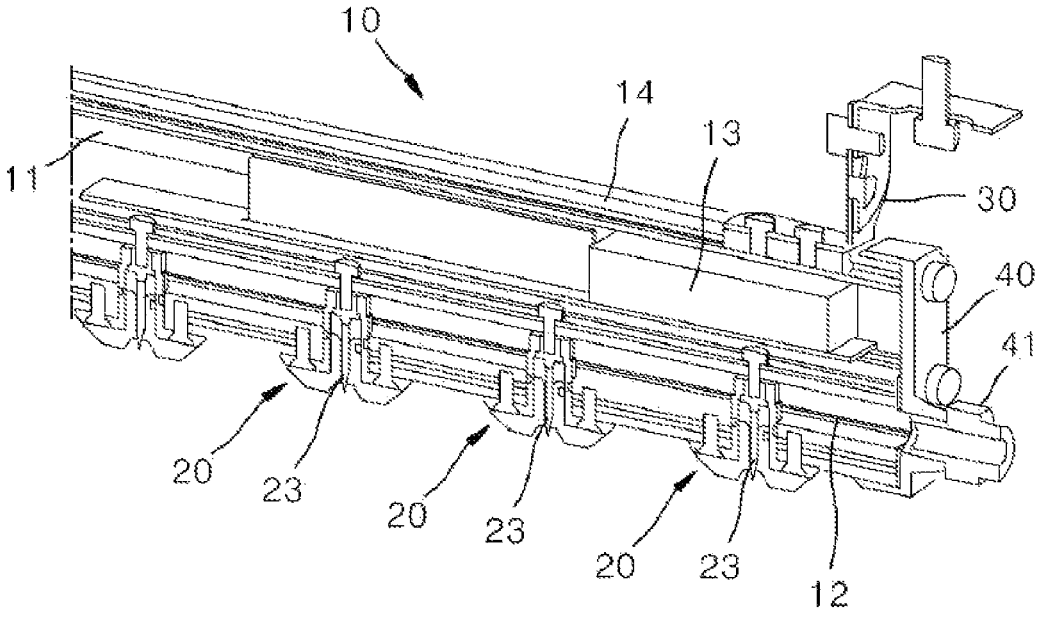
FIGS. 6 and 7 are a partially cutaway perspective view and a side cross-sectional view showing a schematic configuration of a static eliminator that comprises an offset voltage reduction unit according to an embodiment of the present invention, respectively.
Figure 7:
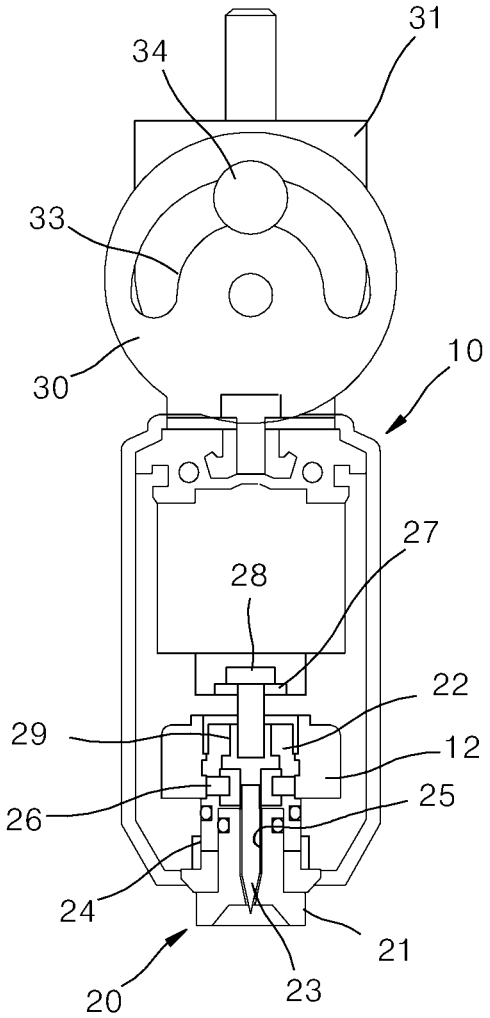

The static eliminator 100 is configured to be capable of discharging to a charged body (not shown) using high-pressure air after generating positive and negative ions by high-voltage discharge, and specific examples thereof are shown in FIGS. 6 and 7. FIGS. 6 and 7 are a partially cutaway perspective view and a side cross-sectional view showing a schematic configuration of a static eliminator that comprises an offset voltage reduction unit according to an embodiment of the present invention, respectively.

Referring to the above drawings, the static eliminator according to an embodiment of the present invention is configured in the form of, for example, an extrusion-molded bar, and thus an upper space 11 and an air passage 12 are formed thereunder. The static eliminator body 10 may include a static eliminator body 10 and a plurality of discharge structures 20 installed on a lower surface of the static eliminator body 10 to be spaced apart from each other by a predetermined interval in the longitudinal direction.

A control unit 13 for controlling and manipulating the static eliminator, an operation panel (not shown), a connector (not shown), etc. may be accommodated in the upper space 11, and the upper surface cover 14 may be installed at an upper open portion thereof to close the control unit 13. Connection brackets 30 are coupled to both ends of the upper cover 14 by fastening means such as bolts, and can be engaged with fixing brackets 31 for fixing the static eliminator to a separate structure (not shown). An arc-shaped slot 33 is formed in each of the connection brackets 30, and the relative installation angle of the static eliminator can be arbitrarily adjusted by a fixing screw 34 that penetrates the arc-shaped slot and fixes the coupling between the connection bracket 30 and the fixing bracket 31 to each other.

The air passage 12 is formed to extend through the longitudinal direction of the static eliminator body 10, and is a passage through which high-pressure air is blown from the outside. The high-pressure air thus supplied may be supplied to the discharge structures 20, which will be described later.

Side covers 40 are installed at opposite-ends openings of the static eliminator body 10, and air inlet terminals 41 to which separate air supply pipes (not shown) are connected may be installed at coupling holes formed in the side covers 40 to communicate with the air passage 12. In addition, a sealing member (not shown) such as a gasket may be further provided between the static eliminator body 10 and the side covers 40 to prevent leakage of high-pressure air flowing into the static eliminator body 10 through the air inlet terminals 41 and the air passage 12.

A plurality of openings may be formed on a lower surface of the static eliminator body 10 to communicate with the air passage 12 while being spaced apart from each other at predetermined intervals in the longitudinal direction, and a discharge structure 20 may be installed in each opening. The discharge structure 20 may include a support member 21 for fixing and supporting a discharge pin, and an annular bracket member 22 for detachably supporting the support member 21.

The support member 21 has an insertion hole 24 having an inner diameter enough to insert and fix the discharge pin 23, and the lower portion thereof, at which the tip of the discharge pin 23 is located, is widely opened, thereby smoothly discharging the ions generated from the discharge pin 23 together with the high-pressure air. An air flow groove 25 may be further formed on the inner surface of the insertion hole 24 to which the discharge pin 23 is inserted and coupled, to allow the high-pressure air supplied from the air passage 12 to flow downward.

At least one ventilation hole 26 communicating with the air passage 12 may be formed on a side surface of the annular bracket member 22, and the air introduced through the ventilation hole 26 passes through the air flow groove 25 and the support member 21 can be released downwards.

A conductive connection screw 28 that is in electrical contact with the conductive plate 27 to which a voltage is supplied may be installed on the upper portion of the annular bracket member 22, and the lower portion of the conductive connection screw 28 may be connected to a conductive metal tube 29 coupled to the discharge pin 23. Accordingly, the voltage supplied to the conductive connection screw 28 through the conductive plate 27 may be applied to the discharge pin 23 through the metal tube 29.

The offset voltage reduction unit 300 is composed of a mesh-type electrode that is assembled and integrated into an aluminum extrudate to include a side portion 300S that opens or covers at least a portion of one side of the static eliminator body 10, and a lower portion 300B that covers at least some of a plurality of discharge structures 20 installed on the lower surface of the static eliminator body 10.

In order to obtain an effect of reducing the offset voltage, the offset voltage reduction unit 300 may be made of various metals such as iron, aluminum, copper, or an alloy thereof but the material thereof is not particularly limited to a specific metal. As another alternative, the offset voltage reduction unit 300 may be manufactured by plating or coating a metal material on a non-metal material.

The offset voltage reduction unit 300 may be used by connecting with the ground of the static eliminator body 10 or may be used as an electrode for ion sensing.

At the same time, the offset voltage reduction unit 300 according to the present invention may include a plurality of openings to allow the ions generated from the discharge structure 20 to pass together with the high-pressure air and to be smoothly discharged toward the charged body (that is, so as not to obstruct or block the flow), and to this end, the offset voltage reduction unit 300 may be configured in the form of a mesh, but is not necessarily limited thereto. For example, the offset voltage reduction unit 300 may be manufactured in the form of a metal plate (not shown) having a plurality of through-holes formed therein, or a grill (not shown) in which metal wires are arranged in one direction (in the horizontal or vertical direction). It should be understood that the offset voltage reduction unit 300 may be manufactured in various forms that can be inferred or modified by those of ordinary skill in the art.

In addition, the offset voltage reduction unit 300 may be rotatably coupled to the upper surface cover 14 of the static eliminator body 10 within a predetermined range by a hinge member 310. Specifically, one end of the hinge member 310 may be fixed to the upper surface cover 14 provided on the upper portion of the static eliminator body 10 by fastening means such as double-sided adhesives or bolts. In addition, the other end of the hinge member 310 may be coupled to the lower side of the offset voltage reduction unit 300 by press-fitting or other methods such as an adhesive. Accordingly, the offset voltage reduction unit 300 of this embodiment is rotatable in arrow directions (A, B) indicated with respect to the static eliminator body 10.

For example, during the antistatic operation to remove static electricity from the charged body, the offset voltage reduction unit 300 is rotated in the arrow direction (A), thereby allowing the lower end 300B to cover at least portions of the plurality of discharge structures 20 provided on the lower surface of the static eliminator body 10. Conversely, during cleaning/maintenance, the offset voltage reduction unit 300 may be rotated in the opposite direction (B), thereby allowing all of the plurality of discharge structures 20 to be exposed. Here, in order to prevent the offset voltage reduction unit 300 from being lifted after rotating in the direction of the arrow (A), the offset voltage reduction unit 300 may further include a magnet fixing unit for fixing the offset reduction unit 300 by a magnetic force. The magnet fixing unit may include a magnet that is installed between two members facing each other and a magnetic body that is a metal attached to the magnet. Here, the magnet is provided in the inner space of a protrusion 330 for matching the height of the offset voltage reduction unit 300 of the hinge member 310, and the magnetic body may be provided in the inner space of a bottom surface 340 of the hinge member 310 facing the inner space of the protrusion 330, or vice versa.

Therefore, for example, the offset voltage reduction unit 300 can be very easily attached or detached as necessary for cleaning and maintenance of the discharge structures 20.

The offset voltage reduction unit of the above-described embodiments has been described with respect to only the mesh-type electrode, but this is only a simple example presented for the convenience of explaining the present invention, and it should be understood that the same concept of configuration and coupling structure can be equally applied to other types of offset voltage reduction units (for example, an offset voltage reduction unit configured by bending a metal plate having a plurality of through-holes or a grill-type offset voltage reduction unit formed by arranging a plurality of metal wires in one direction).

Furthermore, it should be understood that not only the above-described embodiments, but also the configuration made by combining all or part of these configurations with each other falls within the scope of the present invention. For example, the same method may be applied to the offset voltage reduction units shown in FIGS. 8 and 9.

Figure 8:
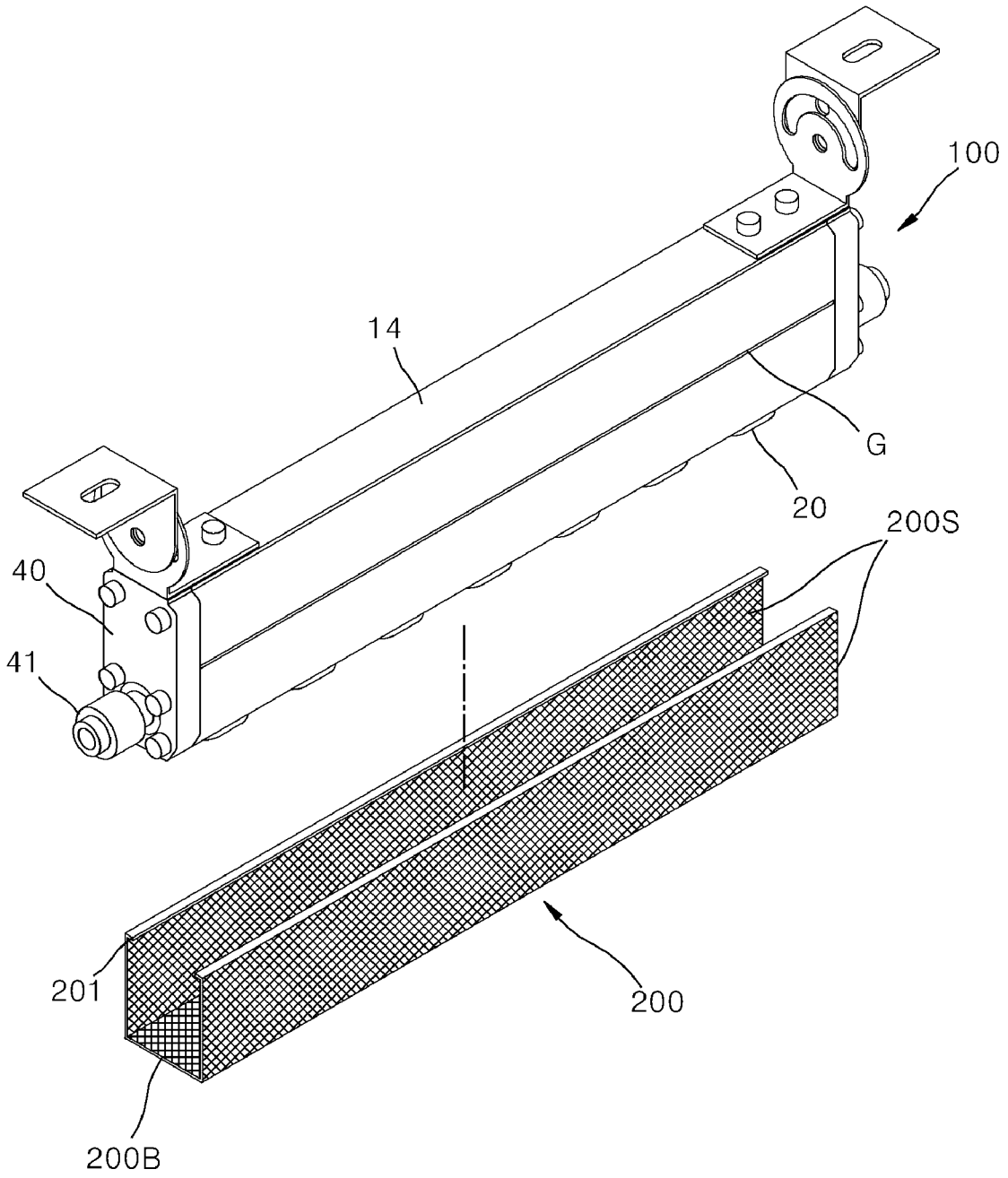
FIGS. 8 and 9 are an exploded perspective view and a combined perspective view schematically showing the configuration of a static eliminator that comprises an offset voltage reduction unit according to another embodiment of the present invention, respectively.
Figure 9:
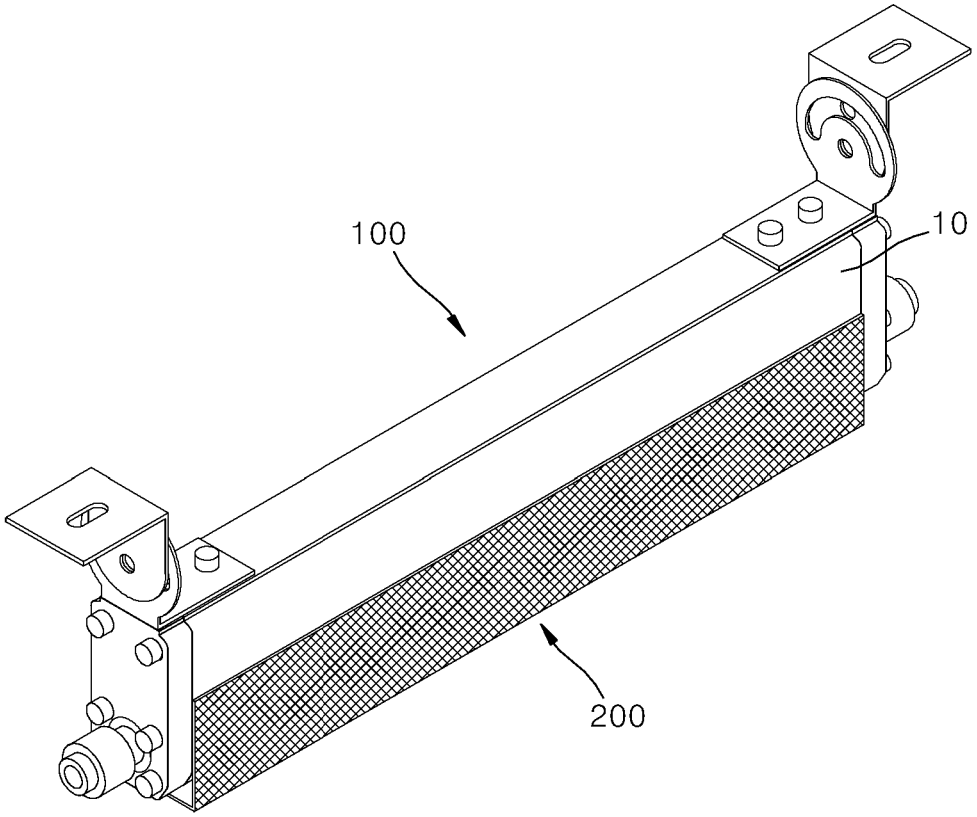

Referring to FIGS. 8 and 9, the offset voltage reduction unit 200 may be installed to be interposed between the discharge structures 20 and the charged body. Specifically, the offset voltage reduction unit 200 may be installed to cover at least portions of a plurality of discharge structures 20 provided on a lower surface of the static eliminator body 10.

In order to obtain an effect of reducing the offset voltage, the offset voltage reduction unit 200 may be made of various metals such as iron, aluminum, copper, or an alloy thereof, but the material thereof is not particularly limited to a specific metal. As another alternative, the offset voltage reduction unit 200 may be manufactured by plating or coating a metal material on a non-metal material.

The offset voltage reduction unit 200 may be used by connecting with the ground of the static eliminator body 10 or may be used as an electrode for ion sensing.

At the same time, the offset voltage reduction unit 200 may include a plurality of openings to allow the ions generated from the discharge structure 20 to pass together with high-pressure air and to be smoothly discharged toward the charged body (that is, so as not to obstruct or block the flow). To this end, the offset voltage reduction unit 200 may be configured in the form of a mesh, but is not necessarily limited thereto. For example, the offset voltage reduction unit 200 may be manufactured in the form of a metal plate (not shown) having a plurality of through-holes formed therein, or a grill (not shown) in which metal wires are arranged in one direction (in the horizontal or vertical direction).

The offset voltage reduction unit 200 shown in FIGS. 8 and 9 may be composed of a mesh-type electrode that is bent to include a side portion 200S that covers at least a portion of one side of the static eliminator body 10, and a lower portion 200B that covers at least some of a plurality of discharge structures 20 installed on the lower surface of the static eliminator body 10.

At least a portion of the upper end of the side portion of the offset voltage reduction unit 200 may be bent inward to form a continuous or discontinuous bent end 201, and the bent end 201 is coupled to a sliding groove G extending in the longitudinal direction on the side surface of the static eliminator body 10 to then be attached to the static eliminator body 10. According to the present embodiment, by coupling the offset voltage reduction unit 200 to the sliding groove G formed in the static eliminator body 10, the offset voltage reduction unit 200 can be freely attached and detached when necessary (for example, when necessary for cleaning and maintenance of the discharge structures 20). As another alternative, at least a portion of the upper end of the side portion 200S of the offset voltage reduction unit 200 is bent inward to form a continuous or discontinuous bent end or hook (not shown), and the bent end or hook may be attached to the static eliminator body 10 by being elastically or forcedly coupled to a coupling groove (not shown) formed on the side surface of the static eliminator body 10. The sliding groove (G) may function as a coupling groove as well.

Figure 10:
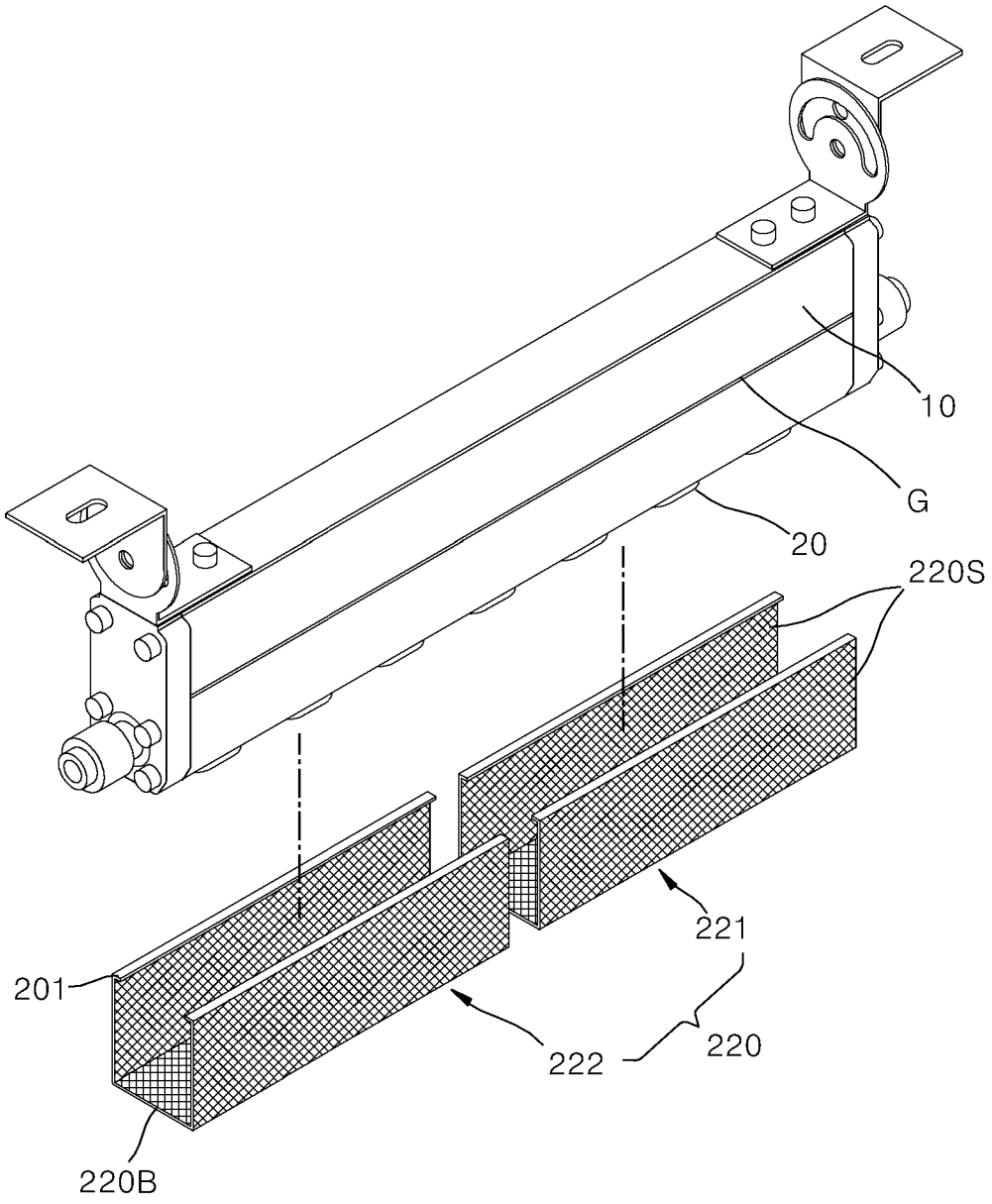
FIGS. 10 and 11 are an exploded perspective view and a combined perspective view schematically showing the configuration of a static eliminator that comprises an offset voltage reduction unit according to the other embodiment of the present invention, respectively.
Figure 11:
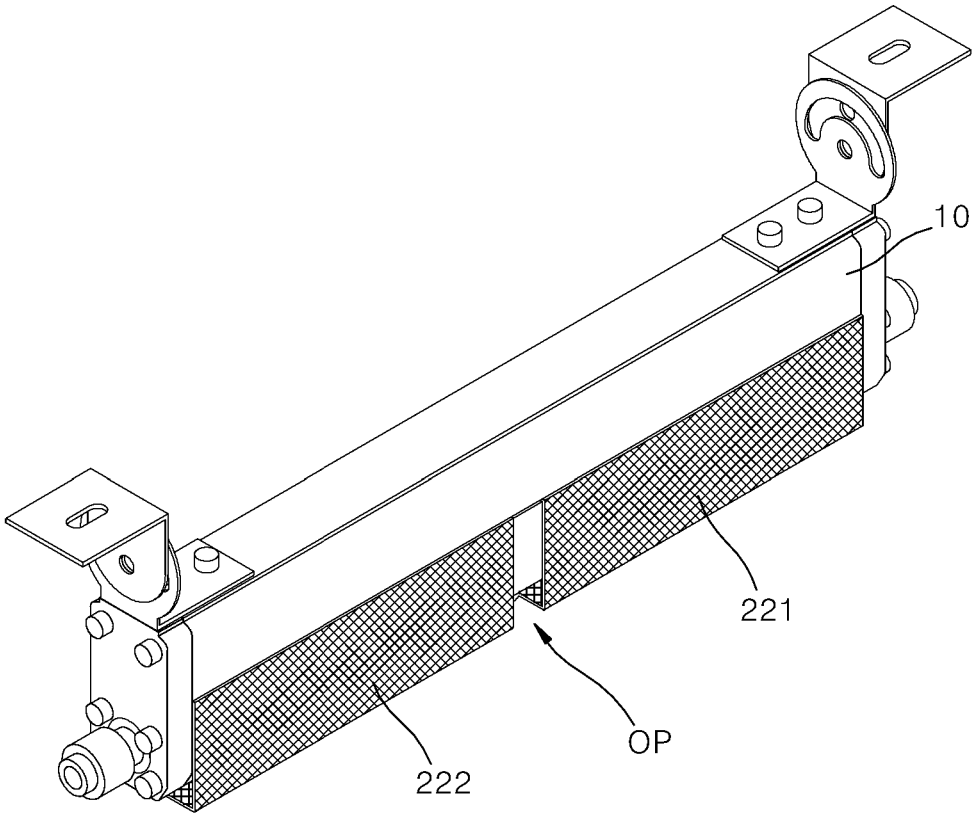

Referring to FIGS. 10 and 11, an offset voltage reduction unit 220 according to the other embodiment of the present invention includes at least two sub-electrodes 221 and 222 covering at least a part of the static eliminator body 10 by means of a fastening member. The offset voltage reduction unit 220 may include, for example, a first sub-electrode 221 and a second sub-electrode 222. Each sub-electrode 221 or 222 may be composed of a mesh-type electrode that is bent to include a side portion 220S that covers at least a portion of one side of the static eliminator body 10, and a lower portion 220B that covers at least some of a plurality of discharge structures 20 installed on the lower surface of the static eliminator body 10.

At least a portion of the upper end of the side portion 220S of each sub-electrode 221 or 222 may be bent inward to form a continuous or discontinuous bent end 201, and the bent end 201 is coupled to a sliding groove G extending in the longitudinal direction on the side surface of the static eliminator body 10 to then be attached to the static eliminator body 10. According to the present embodiment, by coupling the offset voltage reduction unit 220 to the sliding groove G formed in the static eliminator body 10, the offset voltage reduction unit 220 can be freely attached and detached when necessary (for example, when necessary for cleaning and maintenance of the discharge structures 20).

Furthermore, each sub-electrode 221 and 222 is individually detachable and detachable, and when attached to the static eliminator body 10 as shown in FIG. 11. An opening OP is secured between the sub-electrodes 221 and 222 (the embodiment of FIG. 11) or on either side (when all of the sub-electrodes 221 and 222 are collected by sliding them to one side). Therefore, it is possible to clean or maintain the discharge structure 20 without completely separating the offset voltage reducing unit 220 from the static eliminator body 10.

An operation of the aforementioned static eliminator according to an embodiment of the present invention having the above configuration will be described.

The static eliminator according to the present invention is brought into proximity to a charged body, which is a target for removing static electricity, and a static elimination operation is performed. Here, a preset high voltage is supplied to a conductive plate 27 provided on the upper portion of the annular bracket member 22 through the control unit and the operation panel. The supplied high voltage is applied to the discharge pin 23 via the conductive metal tube 29 through the conductive connection screw 28 being in contact with the conductive plate 27. For example, a positive voltage is applied to one of two neighboring discharge pins 23 and a negative voltage is applied to the other discharge pin 23, or a positive voltage and a negative voltage are alternately applied to the one discharge pin 23 as pulses. Accordingly, positive/negative ions are generated from the discharge pins 23 while corona discharge is generated between opposite electrodes.

At the same time, high-pressure air is introduced into the air passage 12 from an air supply pipe (not shown) connected to the air inlet terminals 41 provided on the side cover 40 of the static eliminator body 10. The introduced high-pressure air flows into the insertion hole 24 of the support member 21 through the ventilation hole 26 formed in the annular bracket member 22, and is discharged to the lower portion of the discharge pin 23 along the air flow groove 25 formed on the inner surface thereof.

Since the support member 21 has the extending openings in the lower portion of the discharge pin 23, the discharged air transports the positive/negative ions generated from the discharge pin 23 toward the charged body, thereby performing an antistatic operation.

In performing such a static elimination operation, when a static eliminator approaches the charged body, for example, at an ultra-short distance of about 10 mm, a phenomenon occurs that the performance of the static eliminator on the charged body is rather deteriorated. In the static eliminator according to the present invention, a device for reducing the offset voltage is interposed between the discharge structures 20 and the charged body, thereby preventing deterioration of the antistatic performance. This effect of the present invention will be confirmed in the experimental examples described in detail below.

Experimental Example

The static eliminator used in this experiment is a static eliminator of the ASG-A series corona ion discharge method, which is the applicant's commercial product, and has the specifications of input voltage DC of 24 V, input current of maximum 300 mA, discharge voltage of 4.75 kV to 5.5 kV, output frequency of 0.1 Hz to 100 Hz, and pulse AC application method. The distance from the charged body, which is a target of removing static electricity, was 10 mm, the pressure of blowing air was 1 Bar, and a Trek 158 was used as a measuring tool.

A static elimination operation is performed by using the static eliminator including the mesh-type offset voltage reduction unit 300 made of steel, shown in FIGS. 1A and 1B (indicated as "Example" in the table below, and as a comparative example for this, an static elimination operation is also performed by using a static eliminator without the offset voltage reduction unit 300 (indicated as "Comparative Example" in the table below), and the results are shown in Table 1 below.

TABLE 1

| | +Offset (V) | −Offset (V) | Offset P-P (V) | +Decay time (s) | −Decay time (s) | Decay avg. (s) |
|---|---|---|---|---|---|---|
| Example | 13.3 | −11.9 | 25.2 | 0.25 | 0.27 | 0.26 |
| Comparative Example | 93.1 | −128.1 | 221.2 | 12.3 | 12.76 | 12.53 |

Figure 12A:
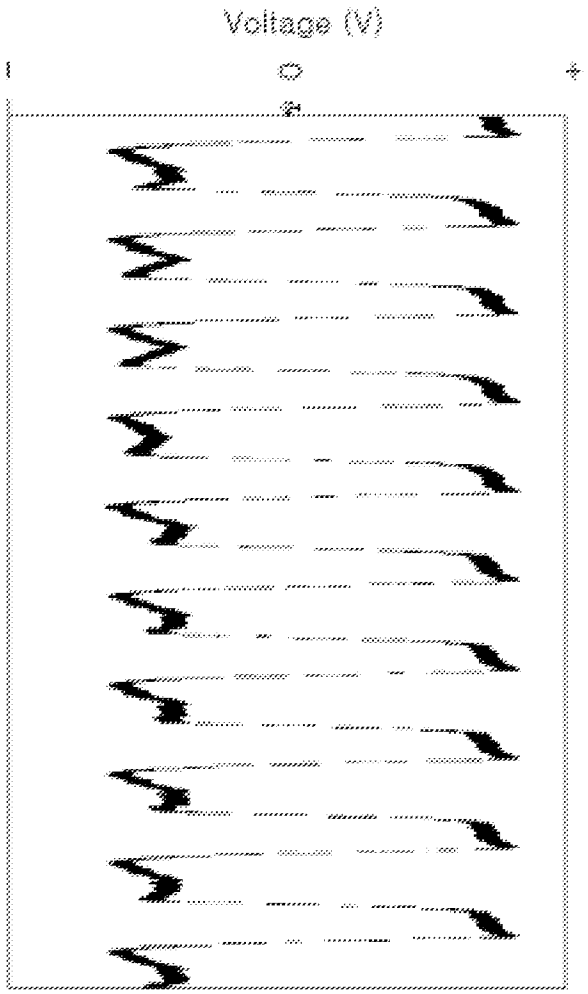
FIG. 12A is a graph illustrating an offset voltage waveform measured during the operation of a static eliminator that does not comprise an offset voltage reduction unit.
Figure 12B:
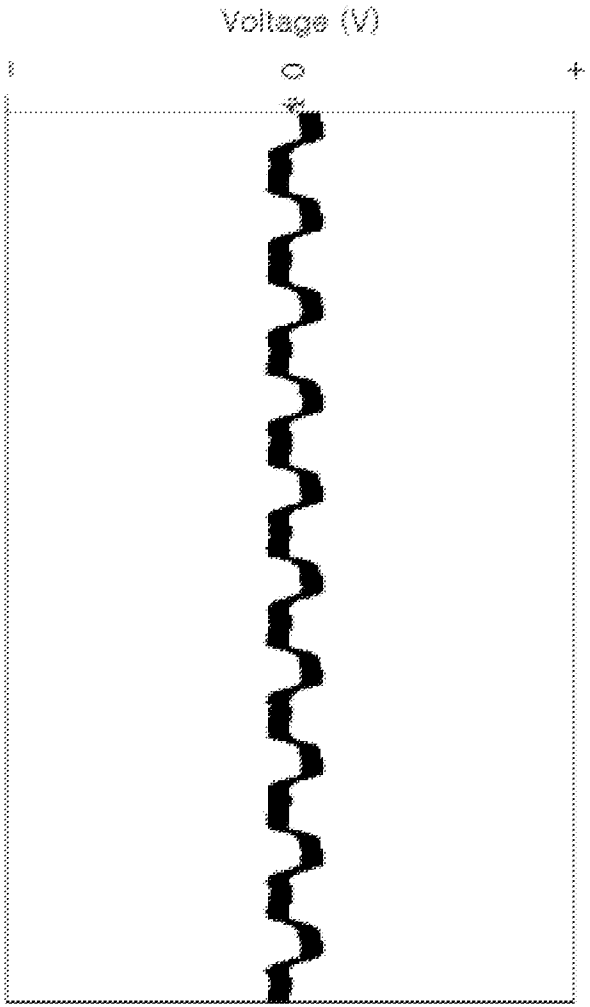
FIG. 12B is a graph illustrating an offset voltage waveform measured during the operation of a static eliminator that comprises an offset voltage reduction unit according to the present invention.

In addition, the results for offset voltage waveforms measured in the charged body are shown in FIGS. 12A and 12B. Here, FIG. 12A shows an offset voltage waveform measured when the offset voltage reduction unit 300 is not provided (Comparative Example), and the voltage width of maximum and minimum voltages is 130 Vp-p.

However, FIG. 12B shows an offset voltage waveform measured when the offset voltage reduction unit 300 is provided (Example of the present invention), unit 300, and the voltage width of maximum and minimum voltages is 40 Vp-p.

As can be seen from the above, when the offset voltage reduction unit 300 according to the present invention is interposed between the static eliminator and the charged body when performing an ultra-short distance static elimination operation, the offset voltage is greatly reduced, thereby significantly reducing the decay time.

Although the present invention has been described in detail through the embodiments and the accompanying drawings, the technical spirit of the present invention is defined by the matters described in the claims, and various modifications and variations within the scope of the technical spirit of the present invention There may be equivalents. In particular, although the above-described embodiment describes a static eliminator having a specific configuration, this is merely an example presented for convenience to explain the present invention, and it should be understood that the technical idea of the present invention can be applied to all static eliminators that generate positive/negative ions by inducing discharge in other methods and structures in addition to the above-described configuration of the static eliminator.

What is claimed is:

1. A static eliminator comprising:

a static eliminator body having an air passage through which high-pressure air is supplied;

a plurality of discharge structures installed at the lower end of the static eliminator body to supply the high-pressure air passing through the air passage, and generating positive/negative ions by discharging using the applied high voltage; and an offset voltage reduction unit having a plurality of openings formed to allow the positive/negative ions and high-pressure air to pass therethrough, and installed to cover at least some of the plurality of discharge structures, wherein the offset voltage reduction unit is formed to have a side portion that opens at least one side of the static eliminator body or covers at least some portions of both sides of the static eliminator body, and a lower end portion that covers the at least some of the plurality of discharge structures.

2. The static eliminator of claim 1, wherein the offset voltage reduction unit is hinge-coupled with respect to the static eliminator body to be cleaned in a state in which the inside thereof is open, and is composed of any one of a mesh made of metal, a metal plate having a plurality of through-holes formed therein, or a grill in which metal wires are arranged in one direction.

3. The static eliminator of claim 1, wherein the offset voltage reduction unit is assembled with any one of a mesh made of metal, a metal plate having a plurality of through-holes formed therein, or a grill in which metal wires are arranged in one direction with an extruded metal rail to then be integrally formed therewith.

4. The static eliminator of claim 1, wherein the offset voltage reduction unit includes at least two sub-electrodes that are bent to have a side portion that covers at least portions of both sides of the static eliminator body and a lower end portion that covers at least some of the plurality of discharge structures.

5. The static eliminator of claim 1, wherein the offset voltage reduction unit is attached to the static eliminator body by means of a fastening member.

6. A static eliminator comprising:

a static eliminator body having an air passage through which high-pressure air is supplied;

a plurality of discharge structures installed at the lower end of the static eliminator body to supply the high-pressure air passing through the air passage, and generating positive/negative ions by discharging using the applied high voltage; and an offset voltage reduction unit having a plurality of openings formed to allow the positive/negative ions and high-pressure air to pass therethrough, and installed to cover at least some of the plurality of discharge structures, wherein the offset voltage reduction unit includes: a side portion that covers at least portions of one side of the static eliminator body; and a lower end portion that is bent with respect to the side portion and covers at least portions of the discharge structures, and the side portion is coupled to the static eliminator body so as to be rotatable within a predetermined range.

* * * * *